US005656004A

United States Patent [19]

Useldinger et al.

[11] Patent Number: 5,656,004

[45] Date of Patent: Aug. 12, 1997

[54] FRICTION TYPE EXERCISING DEVICE WITH FORCE GAUGE AND SHOULDER MOUNTING SCREW

[75] Inventors: Ronald E. Useldinger, Scotts Valley; Paul Eric Peterson, San Francisco, both of Calif.

[73] Assignee: Fitness Motivation Institute of America, Scotts Valley, Calif.

[21] Appl. No.: 746,835

[22] Filed: Nov. 18, 1996

[51] Int. Cl.[6] ..... A63B 21/018

[52] U.S. Cl. ..... 482/120; 482/114

[58] Field of Search ..... 482/114, 115, 482/120, 110

[56] References Cited

U.S. PATENT DOCUMENTS

| | | | |
|---|---|---|---|
| 3,197,204 | 7/1965 | Holkevick et al. | 482/120 |
| 3,220,511 | 11/1965 | Holkesvick et al. | 482/120 |
| 3,411,776 | 11/1968 | Holkesvick et al. | 482/120 |
| 3,460,392 | 8/1969 | Kolbel | 482/120 |
| 3,550,726 | 12/1970 | Chezem | 482/120 |
| 3,591,174 | 7/1971 | Silberman | 482/120 |
| 3,717,339 | 2/1973 | Holkesvick et al. | 482/120 |
| 3,782,722 | 1/1974 | Webb | 482/120 |
| 4,027,876 | 6/1977 | Johnston | 482/120 |
| 4,040,627 | 8/1977 | Useldinger | 482/120 |
| 4,294,446 | 10/1981 | Moore . | |
| 4,560,160 | 12/1985 | Smith | 482/120 |

FOREIGN PATENT DOCUMENTS

| | | | |
|---|---|---|---|
| 23778 | 2/1981 | European Pat. Off. | 482/120 |
| 1108199 | 4/1968 | United Kingdom | 482/120 |

*Primary Examiner*—Lynne A. Reichard

[57] ABSTRACT

An improved friction type exercise device of the type in which a housing has an outer wall forming a hollow cavity with a central axis. A central shaft is positioned within the cavity and positioned to allow axial and rotative movement relative to the housing when moved in one axial direction and preventing axial rotative movement relative to the housing when moved in the other axial direction. A hub is positioned in the cavity and fixed to the shaft to move axially therewith while allowing rotation of the shaft relative to the hub, the hub being nonrotatable with respect to the housing and includes a first and a second opening. A rope-like member extends through the first opening in the hub, around the shaft and out the second opening in the hub whereby when the rope-like member is pulled frictional resistance is exerted on the rope-like member in proportion to the number of turns around the shaft. The rope-like member is attached to the shaft whereby with relative rotation of the shaft and the hub, the number of turns the rope-like member about the shaft is changed. A releasable mechanism for holding the shaft against rotation relative to the housing which when released allows rotation of the shaft within the cavity thereby to change the number of turns the rope-like member is wound around the shaft. A slide is positioned within the cavity and a connecting mechanism for the slide, shaft, and housing to cause movement of the slide in the direction parallel of the central axis with relative rotation between the shaft and the housing. A force gauge meter for showing a force imparted on the rope-like member and a duration of time which said force is applied to the rope-like member is operably linked to a transducer secured within the housing for measuring a force applied to the exercise device and converting the force into an electrical signal readable on the force gauge meter. A shoulder screw is used with a mounting eyelet to secure and position the central shaft.

11 Claims, 3 Drawing Sheets

FRICTION TYPE EXERCISING DEVICE WITH FORCE GAUGE AND SHOULDER MOUNTING SCREW

BACKGROUND OF THE INVENTION

1. Field of Invention

This invention relates to exercise devices, and particularly to exercising devices of the type utilizing a rope wrapped around a shaft to create a frictional force resisting pull on the rope and having a shoulder screw mounting and a force gauge meter for force, heart, and time readings.

2. Description of the Related Art

Various exercise apparatus have been proposed and implemented to facilitate exercise and to provide the user with a convenient means of achieving a desired level of fitness. The present invention relates to exercise devices of the type utilizing a rope wrapped around a shaft to create frictional force resisting pull on the rope. This genre of exercise device is shown in such patents as U.S. Pat. No. 4,040,627 issued to Useldinger Aug. 1977, and U.S. Pat. No. 4,294,446 issued to Moore Oct. 1981. In these devices, the rope is passed into a cavity in a housing having a center shaft. The rope is wrapped about the shaft and passed back out through the body member.

Using such prior devices, exercise is accomplished by pulling on one end of the rope against the frictional force created thereon in the device. The frictional force is adjusted by rotating the shaft relative to the housing. Although useful and effective, such prior devices did not provide the user with a visual indication of the resistive force exerted on the rope, which resistive force is proportional to the number of turns the rope is wound around the center shaft. As such, the user was unable to see what force and/or heart readings were being exerted during use, nor could the user conveniently time the duration of exercise. Further, such prior devices, although generally safe and efficient, lacked a truly efficient locking means to prevent accidental release of the rope during use.

Accordingly, it is the primary object of this invention to provide a friction type exercise device utilizing a rope wrapped around a shaft to create a frictional force resisting pull on the rope which includes a force gauge meter for measuring force and time readings, and a shoulder mounting screw to prevent accidental release of the rope or central shaft and which is simple, safe, and highly effective in use, and which inexpensive to manufacture.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

An improved friction type exercise device of the type in which a housing has an outer wall forming a hollow cavity with a central axis. A central shaft is positioned within the cavity and positioned to allow axial and rotative movement relative to the housing when moved in one axial direction and preventing axial rotative movement relative to the housing when moved in the other axial direction. A hub is positioned in the cavity and fixed to the shaft to move axially therewith while allowing rotation of the shaft relative to the hub, the hub being nonrotatable with respect to the housing and includes a first and a second opening. A rope-like member extends through the first opening in the hub, around the shaft and out the second opening in the hub whereby when the rope-like member is pulled frictional resistance is exerted on the rope-like member in proportion to the number of turns around the shaft. The rope-like member is attached to the shaft whereby with relative rotation of the shaft and the hub, the number of turns the rope-like member about the shaft is changed. A releasable mechanism for holding the shaft against rotation relative to the housing which when released allows rotation of the shaft within the cavity thereby to change the number of turns the rope-like member is wound around the shaft. A slide is positioned within the cavity and a connecting mechanism for the slide, shaft, and housing to cause movement of the slide in the direction parallel of the central axis with relative rotation between the shaft and the housing. A force gauge meter for showing a force imparted on the rope-like member and a duration of time which the force is applied to the rope-like member is operably linked to a transducer secured within the housing for measuring a force applied to the exercise device and converting the force into an electrical signal readable on the force gauge meter. The force gauge meter is preferably secured to the housing by a mounting eyelet and spring element. A shoulder screw may used with a mounting eyelet to secure and position the central shaft.

Various transducers may be used to converting the force applied to the exercise device into an electrical signal readable on the force gauge meter. For example, magnetic, optical, capacitive and resistive transducers may be used, with magnetic and optical transducers being preferred.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Reference will now be made in detail to the present preferred embodiments of the invention as illustrated in the accompanying drawings.

In accordance with the present invention, there is provided as seen in FIGS. 1 to 6 an improved friction type exercise device of the type in which a housing has an outer wall forming a hollow cavity with a central axis. A central shaft is positioned within the cavity and positioned to allow axial and rotative movement relative to the housing when moved in one axial direction and preventing axial rotative movement relative to the housing when moved in the other axial direction. A hub is positioned in the cavity and fixed to the shaft to move axially therewith while allowing rotation of the shaft relative to the hub, the hub being nonrotatable with respect to the housing and includes a first and a second opening. A rope-like member, which may be a rope, cord, wire, or the like, extends through the first opening in the hub, around the shaft and out the second opening in the hub whereby when the rope-like member is pulled frictional resistance is exerted on the rope-like member in proportion to the number of turns around the shaft. The rope-like member is attached to the shaft whereby with relative rotation of the shaft and the hub, the number of turns the rope-like member about the shaft is changed. A releasable mechanism for holding the shaft against rotation relative to the housing which when released allows rotation of the shaft within the cavity thereby to change the number of turns the rope-like member is wound around the shaft. A slide is positioned within the cavity and a connecting mechanism for the slide, shaft, and housing to cause movement of the slide in the direction parallel of the central axis with relative rotation between the shaft and the housing. A force gauge meter for showing a force imparted on the rope-like member and a duration of time which said force is applied to the rope-like member is operably linked to a transducer secured within the housing for measuring a force applied to the exercise device and converting the force into an electrical signal readable on the force gauge meter. The force gauge meter is preferably secured to the housing by a mounting eyelet and spring element. A shoulder screw may used with a mounting eyelet to secure and position the central shaft.

Figure 1:
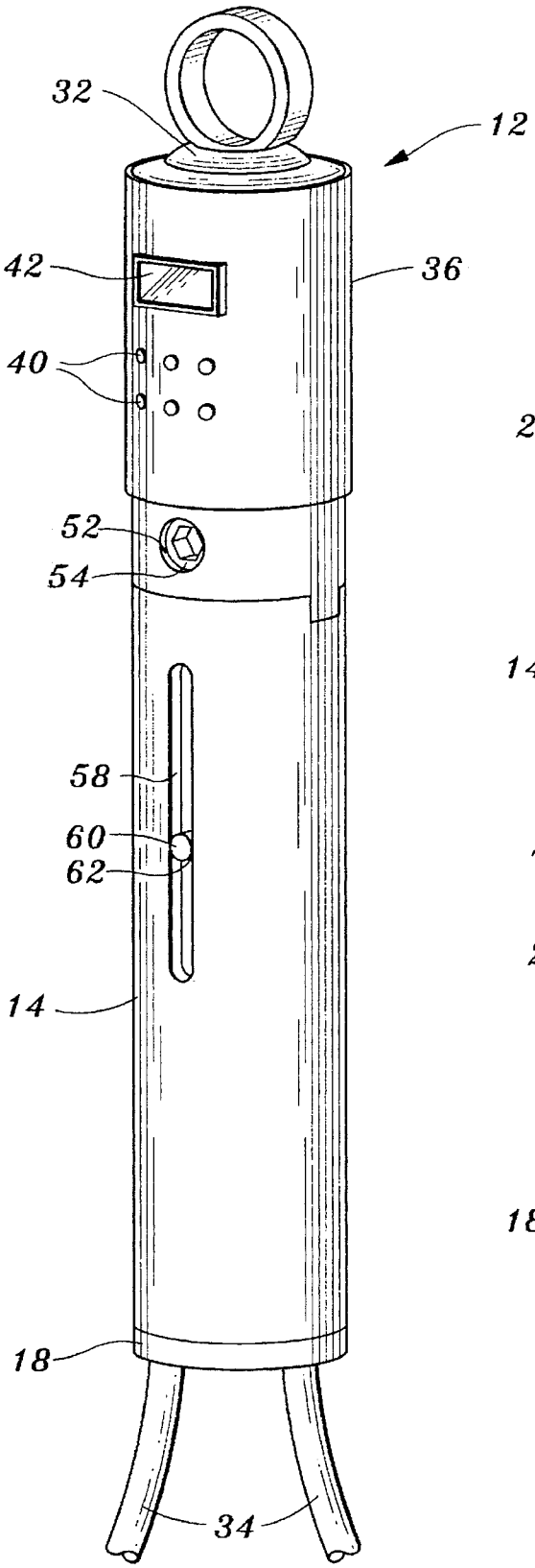
FIG. 1 is a view of an improved frictional type exercise device with force gauge meter attached, according to the invention.
Figure 1A:
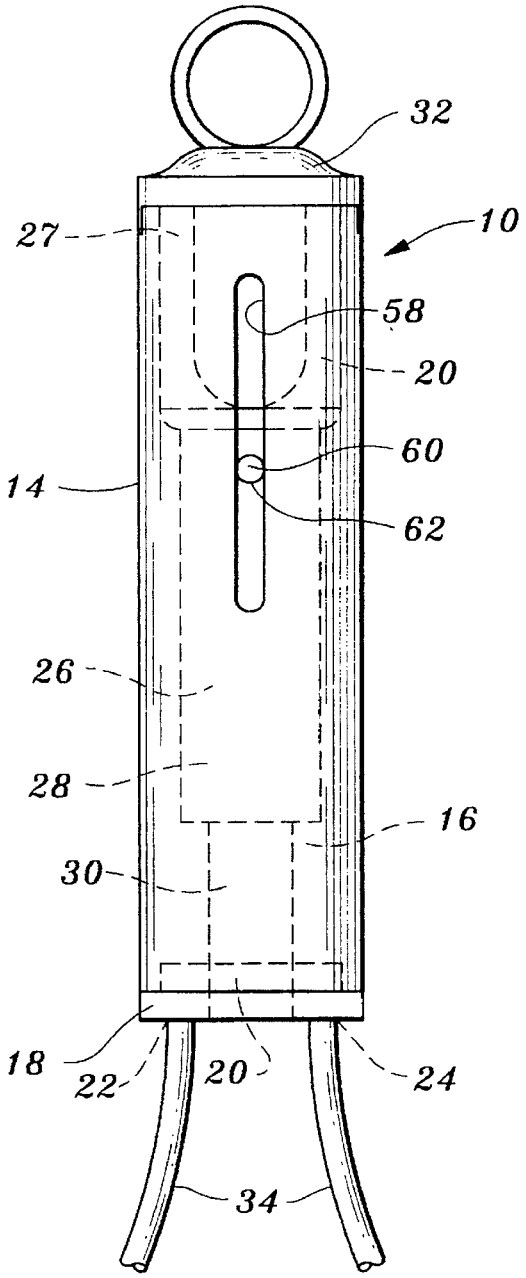
FIG. 1A is a view of a prior generic friction type exercise device shown for illustrative purpose and comparison.

In reference to FIGS. 1 and 1A, a prior friction type exercise device 10, is shown in FIG. 1A, and an improved friction type exercise device 12, is shown in FIG. 1. In the prior friction type exercise device a housing 14 encloses a center cavity 16. Typically the housing is cylindrical in configuration as is the cavity. A hub 18 is positioned to form one end wall of the cavity and may be provided with a center opening 20 and a first opening 22 and a second opening positioned on opposite sides of the center opening. The hub way include ridges on the outer periphery thereof which align with slot on the inner surface of the housing to prevent rotation relative to the housing. A center shaft 26 forms a central axis of the housing and includes a substantially forked portion 27 a center portion 28, and a reduced diameter portion 30 separated by a shoulder. The small diameter end portion 30 fits through an opening in the hub and is held there by a bolt or other fastening means. Center shaft 26 includes a flange 32 positioned at the end thereof.

The prior friction type exercise device, as seen in FIG. 1A also included a rope-like member 34 threaded through the first opening of the hub and extending along the shaft to be passed through a rope opening and to be passed through the second opening in the hub. Movement of the rope-like member through the exercise device is resisted by a force resulting from the frictional engagement between the rope and the shaft 26. The more turns of the rope about the shaft the greater the frictional engagement. For adjustment of the rope turn about the shaft, the shaft is supported by means permitting rotation within the housing. Typically, in prior devices, one or more lugs fit within recessed in an end wall member formed integral with and closing the second end of the housing 14. To hold the shaft in a locked position, that is stationary relative to the housing, a spring may be used to bias hub 14 in a direction to hold lugs in the recesses. Prior devices used a single screw thread on the outer cylindrical surface and a corresponding slide having a curved configuration to visually indicate to the user the number of turns on the rope. Openings and a sleeve in the housing were provided through which the rope is passed as it extends away from a rope opening in the shaft. An indicator pin 60 attached to lug 62 extended through opening 58. Thus the housing and sleeve allows axial movement of the shaft as is necessary before rotation of the shaft is effected, but rotates with the housing as the shaft is rotated. Rotation of the shaft and sleeve causes the slide to move in the direction of the central axis of the housing since the slide is held against rotation within the housing. The only means provided in such prior exercise devices for indicating the force on the rope were markings printed on the outside of housing 14.

The improved friction type exercise device shown in FIG. 1, is preferably provided with a force gauge means for measuring the force exerted on device 12 through the pulling of rope-like member 34, which may be a rope, cord, wire, or the like, and the duration or length of time of exertion of force. Preferably, force gauge means comprise a force gauge meter 36. Force gauge meter 36 includes electronics sleeve or panel 38 with control buttons 40, such as start, stop, time, force, etc., and an LED display 42 for display of the measured parameters. Force gauge meter 36 is preferably mounted to housing 14 by a mounting eyelet 44 operably connected to a spring element 46, flange 32, or to a shoulder mounting screw 52 secured to a mounting eyelet 52 by securing shoulder screw 52 through aperture 54 in housing 14 and through the eyelet of mounting eyelet 50.

Figure 3:
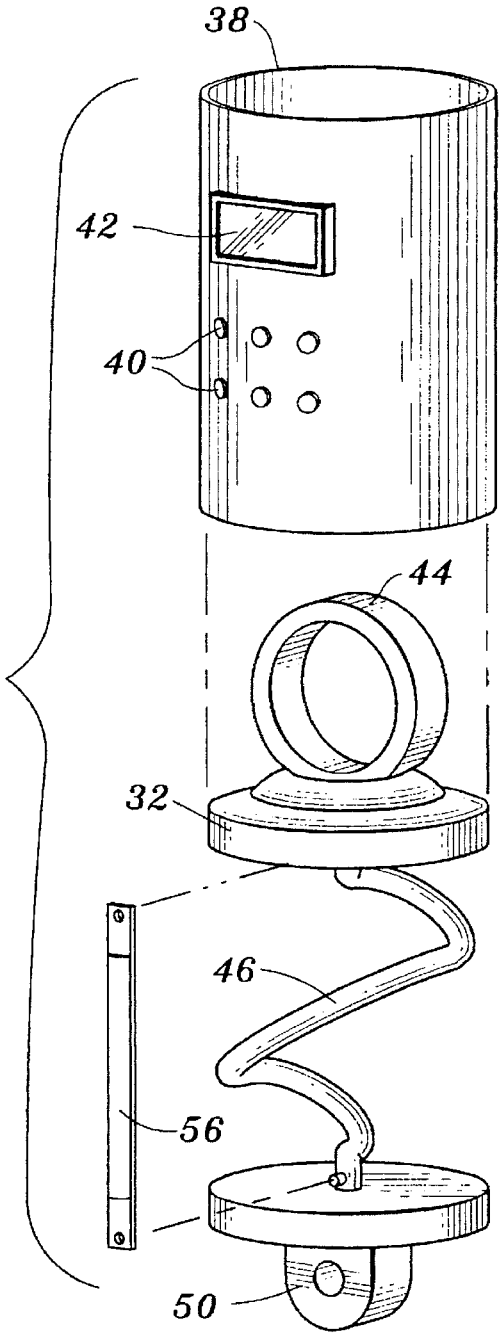
FIG. 3 is an exploded view of the force gauge meter, mounting eyelet and spring element, and transducer, according to the invention.

A transducer means, preferably transducer 56 best seen in FIG. 3, is secured within housing 14 to spring element 46 which is secured to central shaft 26 and communicativly linked to electronic sleeve 38 and LED display 42 so as to measure and convert the force applied to the central shaft via rope-like member 34 into an electrical signal readable on LED display 42. Transducer 56 measures the change in mechanical dimension of a load bearing piece, preferably that of spring element 46 when force is applied through rope-like member 34 on central shaft 26. Transducer 56 is preferably a magnetic transducer which produces a signal via magnetic coupling between a source and a detector. For example, low cost magnetic sensing may be achieved with a Hall-effect sensor that moves in a magnetic field gradient. Alternatively, an optical transducer may be used which utilizes optical techniques to convert a change in distance between two points into an electrical signal. The preferred method to implement uses a light source and a light detector configured in a way such that the amount of light which falls on the detector changes as the distance between the two points change. Examples include fiber-optic coupled devices, structured-light/detector systems and tilting mirror devices. In still other embodiments, resistive transducers or capacitive transducers may be used.

Figure 4:
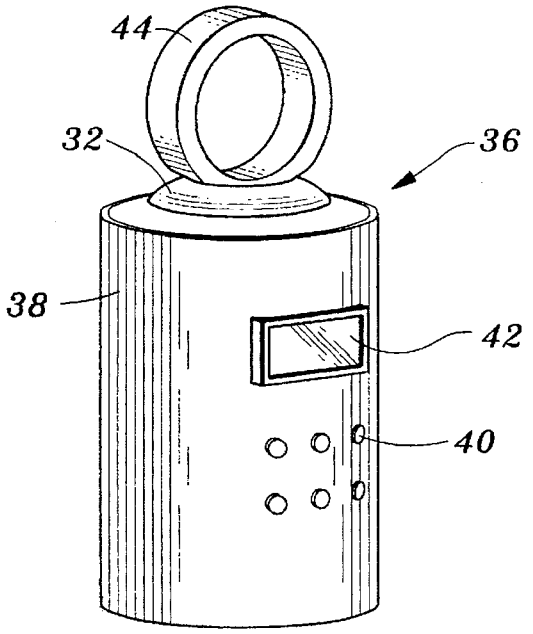
FIG. 4, is a view of an assembled force gauge meter, according to the invention.

With reference now to FIG. 4, an assembled force gauge meter is shown separated from the friction type exercise device 12. Preferably, force gauge meter 36 is provided as an electronic sleeve which is mounted on mounting eyelet 44 and spring element 46. Mounting eyelet 44 is preferably a single die cast aluminum piece, however, other metals, alloys, or composites may be used, such as steel, bronze, copper, titanium, and alloys thereof. Spring element 46 is operably coupled to transducer 56 so that mechanical distortion or change of dimension of spring element 46 is sensed by transducer 56 and an electrical signal relayed to electronic sleeve 38. The electronic signal is then readable on LED display 42.

Figure 2:
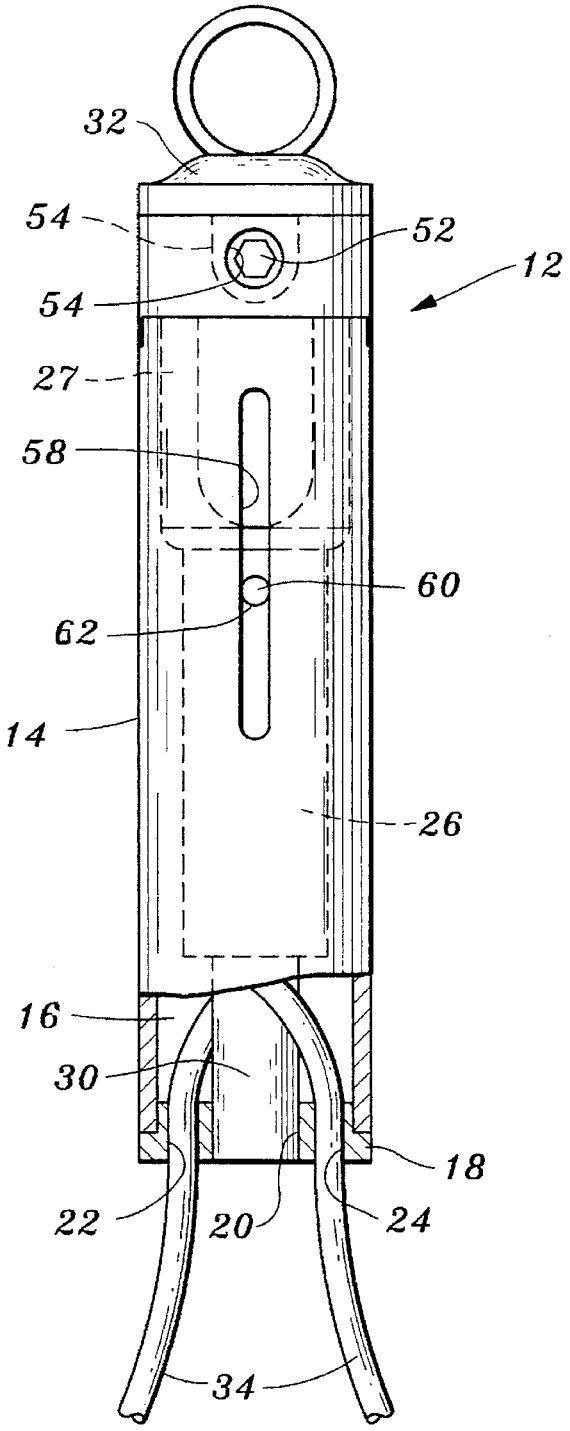
FIG. 2 is a view of an improved frictional type exercise device with shoulder mounting screw, according to the invention.
Figure 5:
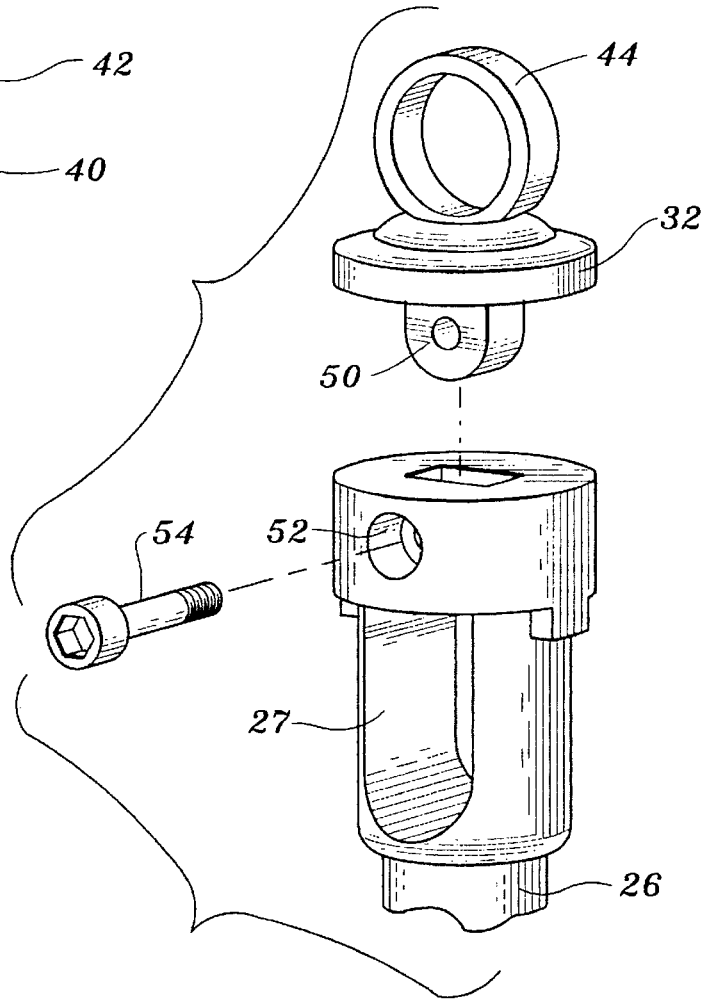
FIG. 5, is an exploded view of the shoulder screw mounting with mounting eyelet, shoulder screw and modified central shaft, according to the invention.
Figure 6:
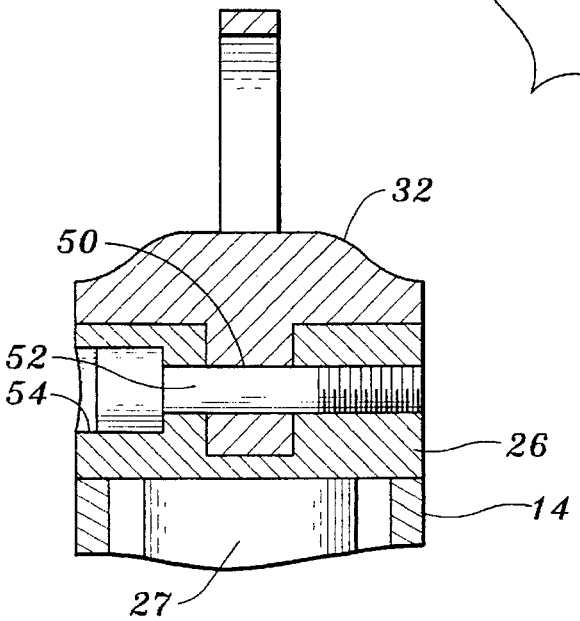
FIG. 6, is a cross sectional view of the shoulder screw mounting, with shoulder screw, mounting eyelet, and modified central shaft.

In FIGS. 2 and 5, an embodiment of exercise device 12 is shown utilizing shoulder mounting screw means, according to an embodiment of the invention. Preferably, shoulder mount screw means comprises a shoulder screw 52, which functions in a manner similar to a clevis pin, that is, a pin which is pushed through matching holes in two interfacing parts. However, in alternative embodiments, shoulder screw 52 may be replaced with a pin, bolt, or other mechanical fastening means. In FIGS. 2, 5, and 6 shoulder screw 52 is secured in aperture 54 in housing 14 and through mounting eyelet 50 secured to flange 32. Distinct advantages of such shoulder screw mounting means include low cost, safety, reliability, and a very low chance of accidental release. As is seen in FIGS. 1 and 2, such shoulder mounting screw means may be used either with or without the force gauge meter.

In operation and use the improved friction type exercise device 12 provides an extremely safe, efficient, and convenient form of exercise. Force gauge meter 36 allows the user to simply and accurately determine the amount of force he or she is exerting and the time duration of the exercise which is readable on LED display 42. Movement of the rope through the exercise device is resisted by a force resulting from the frictional engagement between the rope and center shaft 26 which is readable on force gauge meter 36. With the force gauge meter there is no guessing or estimation of the force or duration of force as these parameters are instantly measured and displayed on LED display 42. Shoulder mounting screw 52 provides an improved mount and prevents accidental release of center shaft 26 and rope-like member 54.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. An improved friction type exercise device of the type in which a housing has an outer wall forming a hollow cavity with a central axis; a shaft is positioned within the cavity and positioned to allow axial and rotative movement relative to the housing when moved in one axial direction and preventing axial rotative movement relative to the housing when moved in the other axial direction; a hub is positioned in the cavity and fixed to the shaft to move axially therewith while allowing rotation of the shaft relative to the hub, the hub being nonrotatable with respect to the housing and includes a first and a second, opening; a rope-like member extends through the first opening in the hub, around the shaft and out the second opening in the hub whereby when the rope-like member is pulled frictional resistance is exerted on the rope-like member in proportion to the number of turns around the shaft; the rope-like member being attached to the shaft whereby with relative rotation of the shaft and the hub, the number of turns the rope-like member about the shaft is changed; a releasable mechanism for holding the shaft against rotation relative to the housing which when released allows rotation of the shaft within the cavity thereby to change the number of turns the rope-like member is wound around the shaft; a slide positioned within the cavity; and a connecting mechanism for the slide, shaft, and housing to cause movement of the slide in the direction parallel of the central axis with relative rotation between the shaft and the housing; and, an opening in the housing in a position to allow viewing of the position of the slide thereby so as to indicate the number of turns the rope-like member is wound around the shaft, wherein the improvement, comprises:

a force gauge means for showing a force imparted on the rope-like member and a duration of time which said force is applied to the rope-like member; said force gauge means being operably linked to a transducer secured within the housing to a spring element and a mounting eyelet for measuring a force applied to the exercise device and converting the force into an electrical signal readable on the force gauge means.

2. The improved friction type exercise device of claim 1, wherein said force gauge means is a force gauge meter.

3. The improved friction type exercise device of claim 1, wherein said transducer is a magnetic transducer.

4. The improved friction type exercise device of claim 1, wherein said transducer is an optical transducer.

5. The improved friction type exercise device of claim 1, wherein said transducer is an inductive transducer.

6. The improved friction type exercise device of claim 1, wherein said transducer is a capacitive transducer.

7. The improved friction type exercise device of claim 1, wherein said mounting eyelet is composed of aluminum.

8. An improved friction type exercise device of the type in which a housing has an outer wall forming a hollow cavity with a central axis; a shaft is positioned within the cavity and positioned to allow axial and rotative movement relative to the housing when moved in one axial direction and preventing axial rotative movement relative to the housing when moved in the other axial direction; a hub is positioned in the cavity and fixed to the shaft to move axially therewith while allowing rotation of the shaft relative to the hub, the hub being nonrotatable with respect to the housing and includes a first and a second opening; a rope-like member extends through the first opening in the hub, around the shaft and out the second opening in the hub whereby when the rope-like member is pulled frictional resistance is exerted on the rope-like member in proportion to the number of turns around the shaft; the rope-like member being attached to the shaft whereby with relative rotation of the shaft and the hub, the number of turns the rope-like member about the shaft is changed; a releasable mechanism for holding the shaft against rotation relative to the housing which when released allows rotation of the shaft within the cavity thereby to change the number of turns the rope-like member is wound around the shaft; a slide positioned within the cavity; and a connecting mechanism for the slide, shaft, and housing to cause movement of the slide in the direction parallel of the central axis with relative rotation between the shaft and the housing; and, an opening in the housing in a position to allow viewing of the position of the slide thereby so as to indicate the number of turns the rope-like member is wound around the shaft, wherein the improvement, comprises:

a shoulder mount screw means for securing said shaft against rotation relative to the housing and which when released allows for controlled rotation of said shaft within said cavity to alter the number of turns the rope-like member is wound around the shaft; said shoulder mount screw means being operably secured to a mounting eyelet and to the shaft.

9. The improved friction type exercise device of claim 8, wherein said shoulder mount screw means comprises a screw.

10. The improved friction type exercise device of claim 8, wherein said shoulder mount screw means is secured within an aperture of said mounting eyelet.

11. The improved friction type exercise device of claim 8, wherein said shoulder mount screw means is secured within an aperture of said shaft.

* * * * *